United States Patent [19]

Shirai

[11] Patent Number: 4,571,052

[45] Date of Patent: Feb. 18, 1986

[54] ELECTRIC FIELD TRANSFER METHOD AND APPARATUS

[75] Inventor: Masaharu Shirai, Ebina, Japan

[73] Assignee: Fuji Xerox Co., Ltd., Tokyo, Japan

[21] Appl. No.: 688,958

[22] Filed: Jan. 4, 1985

[30] Foreign Application Priority Data

May 31, 1984 [JP] Japan ..... 59-109738

[51] Int. Cl.[4] ..... G03G 15/16

[52] U.S. Cl. ..... 355/3 TR; 355/14 TR; 250/324

[58] Field of Search ..... 355/3 TR, 14 TR, 3 CH, 355/14 CH; 250/324, 326

[56] References Cited

U.S. PATENT DOCUMENTS

| | | | |
|---|---|---|---|
| 2,777,957 | 1/1957 | Walkup | 250/324 |
| 3,877,417 | 4/1975 | Jeromin | 355/3 TR X |
| 3,936,174 | 2/1976 | Carpenter | 355/3 TR |
| 4,223,993 | 9/1980 | Tsuda et al. | 355/3 TR X |
| 4,379,630 | 4/1983 | Suzuki | 355/3 TR |
| 4,411,512 | 10/1983 | Springer | 355/3 TR |
| 4,518,976 | 5/1985 | Tarumi et al. | 355/3 TR X |

*Primary Examiner*—A. C. Prescott

*Attorney, Agent, or Firm*—Frost & Jacobs

[57] ABSTRACT

A method and device for transferring toner image from the surface of a photosensitive plate to a sheet of paper. The transfer device comprises a substrate having volume resistivity of $10^6$ to $10^{16}\Omega$.cm and surface resistivity of $10^6$ to $10^{16}\Omega$, an elongated conductive member laid on the substrate and a coating layer having volume resistivity of more than $10^{11}\Omega$.cm and surface resistivity of more than $10^{11}\Omega$. A narrow electric field is created between the elongated conductive member and the surface of the photosensitive plate by applying high DC voltage across the elongated conductive member and a conductive substrate of the photosensitive plate whereby the toner image is transferred from the photosensitive plate to the sheet of paper due to this narrow electric field.

8 Claims, 7 Drawing Figures

ELECTRIC FIELD TRANSFER METHOD AND APPARATUS

BACKGROUND OF THE INVENTION

1. Field of the Invention

The present invention relates to a method for transferring a toner image formed electrostatically on the surface of a photoconductive plate or a dielectric material onto the surface of a sheet of toner receiving material in an electrophotographic copying apparatus or an electrostatic printer, and a transfer device for use in practicing the said method.

2. Prior Art

Heretofore, as a device for transferring a toner image formed electrostatically on the surface of a photoconductive plate or a dielectric material onto the surface of a sheet of toner receiving material (hereinafter reffered to as a sheet of paper) in an electrophotographic copying apparatus, there has widely been used a charging device which utilizes corona discharge such as corotron. In this type of charging device, a fine metallic wire such as tungsten wire which is difficult to be damaged by corona discharge, or such metallic wire coated with an insulating material such as glass, is used. In using such charging devices for the transfer purpose, a high DC or AC voltage of 4,000 to 8,000 volts is applied between the aforementioned metallic wire (discharge wire) and a sheath-like metallic case called a shield which surrounds the discharge wire in spaced relation, thereby inducing corona discharge around the discharge wire, and the resultant positive or negative electric charge is released from an opening portion of the above shield and applied to the back of a sheet of paper, thereby inducing a transfer field between the paper and the photosensitive plate or dielectric material. Consequently, a high voltage current source is needed for inducing corona discharge around the discharge wire. Moreover, for the stabilization of discharge, the greater part of the corona discharge current is allowed to flow the shield without direct utilization for the transfer.

Further, because of the necessity of applying an electric charge uniformly to the paper, the fine metallic wire must be spaced 1 cm or so from the surface of a photosensitive plate or a dielectric material. Consequently, the electric charge is applied more widely than necessary to the back of the transfer part of the paper and the transfer field spreads, so that the toner image to be transferred is apt to be disturbed. This tendency is marked particularly when the photosensitive plate is a drum surface of a small diameter. In applying an electric charge to the paper, the applied charge may leak and cause a poor transfer in the case where the paper is influenced by the ambient humidity and its resistance is thereby decreased. To avoid this inconvenience, it is necessary to take measures for facilitating transfer of a toner image, for example, electrically insulating a sheet of paper under transfer from surrounding objects, or weakening the electrostatic adhesion between the toner image and the photosensitive plate or dielectric material.

In separating the paper from the photosensitive plate or dielectric material after transfer, the paper adheres to the surface of the photosensitive plate or dielectric material due to the electric charge applied thereto, and is therefore difficult to separate, thus requiring means for deelectrifying the paper after transfer. Moreover, due to the inflow of corona ion to the surface of the photosensitive plate, the photosensitive plate is apt to be deteriorated. Further, from the characteristic standpoint, it is difficult to form the section of the charging device not larger than several square centimeters.

As transfer means, a roller type transfer device is known in addition to the above charging device which utilizes corona discharge. In this transfer device, a semiconductive roller or a conductive roller having an insulating layer on the surface thereof, with DC voltage applied thereto, is pushed against a toner image formed on the surface of a photosensitive plate or the like to thereby effect transfer of the toner image. In this transfer device, the amount of electric charge applied to a sheet of paper is less than that in the charging device using the corona discharge, and the applied voltage can be somewhat reduced. But, due to pressing, the transferred toner image is apt to undergo transfer defects, e.g. image omission. Further, the roller type transfer device involves the problem of increase in size of the apparatus.

Thus, the main transfer methods presently in use have various inconveniences.

SUMMARY OF THE INVENTION

It is an object of the present invention to provide a novel transfer method and transfer device capable of overcoming the above-mentioned problems of the conventional transfer methods.

According to an aspect of the present invention there is provided a field transfer method in which at least one elongated conductor having a cylindrical or knife edge-like peripheral surface with a radius of curvature not larger than 3 mm is put on the surface of a base plate formed of a material having a volume resistivity in the range of $10^6$ to $10^{16}$ Ω.cm and a surface resistivity in the range of $10^6$ to $10^{16}$Ω, the surface of the base plate is spaced at a predetermined distance from the surface of a photoconductive plate or dielectric material which supports a toner image electrostatically, and a desired high potential is applied through said conductor to a conductive substrate of the photosensitive palte or dielectric material to form a narrow electric field on the surface of the photosensitive plate or dielectric material through a sheet of paper which is fed between the surface of the photosensitive plate or dielectric material and the base plate with the conductor put thereon and without imparting an electric charge to the paper, thereby transferring the toner image onto the surface of the paper.

According to a perferred embodiment of the present invention, the surface of the base palte is covered with a coaring layer having a volume resistivity not less than $10^{11}$Ω.cm and a surface resistivity not less than $10^{11}$Ω so that dielectric breakdown of air may not occur on the conductor surface when a transfer field inducing potential is applied to the conductor.

According to the present invention, moreover, there is provided a transfer device in which at least one elongated conductor having a cylindrical or knife edge-like peripheral surface with a radius of curvature not larger than 3 mm is put on the surface of a base plate formed on a material having the volume resistivity in the range of $10^6$ to $10^{16}$Ω.cm and a surface in the range of $10^6$ to $10^{16}$Ω, and the base plate is covered with a coating layer having a volume resistivity not less than $10^{11}$Ω.cm and a surface resistivity not less than $10^{11}$Ω so as to enclose the said conductor.

According to a preferred embodiment, the elongated conductor is put in a slot formed in V or any other suitable shape in the surface of the base plate. Further, the transfer efficiency can be improved by providing a plurality of such elongated conductors on the base plate.

The above and other objects, features and advantages of the present invention will become readily apparent from the following description taken in conjunction with the accompanying drawings.

DESCRIPTION OF THE PREFERRED EMBODIMENTS

The method of the present invention and the transfer device for practicing the method will be described in more detail hereinunder with reference to the drawings.

Figure 1:
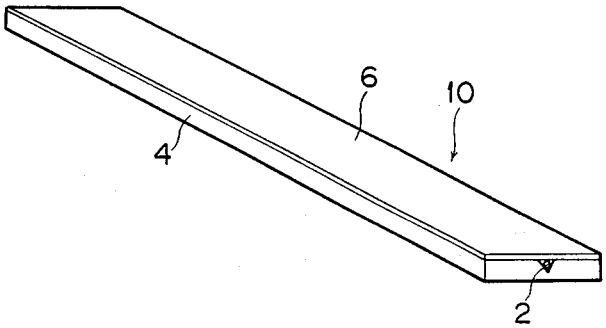
FIG. 1 is a perspective view of transfer device according to an embodiment of the present invention.
Figure 2:
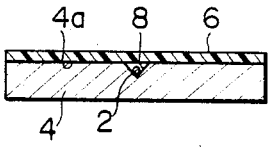
FIG. 2 is a transverse sectional view thereof.

FIG. 1 is a perspective view showing a typical example of a transfer device used for practicing the method of the present invention, in which the numeral 2 denotes a cylindrical tungsten conductor having a diameter of about 90 μm. The conductor 2 is put straight in a V-shaped groove with a depth of 0.2–0.5 mm, the V-shaped groove being formed in a base plate surface 4*a* of a semiconductive base plate or substrate 4 so that the conductor 2 put therein is lower than the base plate surface, the semiconductive base plate 4 being 32 cm long, 1 cm wide and 1 mm thick and having a volume resistivity of $10^{11}\Omega$.cm and a surface resistivity of $10^{12}\Omega$. The base plate surface 4*a* is covered with an unsaturated polyester coating layer 6 having a volume resistivity of about $10^{16}\Omega$.cm and a thickness of 0.1–0.2 mm, and the conductor 2 is embedded in this layer. FIG. 2 is a transverse sectional view of the transfer device of FIG. 1, in which the conductor 2 is put in a V-shaped groove 8 formed in the base plate surface 4*a*.

Figure 3:
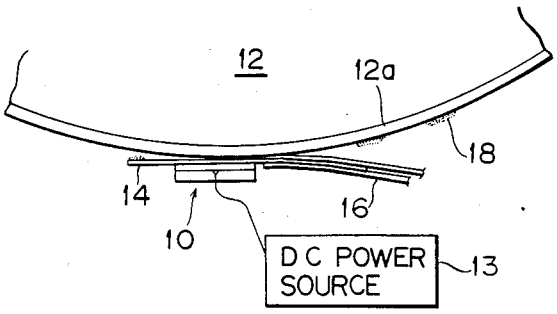
FIG. 3 is a schematic view of the transfer device as installed for transfer of toner image on a photosensitive drum to a sheet of paper.

In transferring a toner image formed electrostatically on the surface of a photoconductive plate onto a sheet of paper by using the thus-constructed transfer device 10, the transfer device 10 is disposed so that the conductor-disposed surface thereof is spaced about 0.5 mm from the surface of a photoconductive palte 12*a*, as shown in FIG. 3, and when a sheet of paper 14 is fed between the surface of the photosensitive plate 12*a* and the transfer device 10 through a sheet of paper guide member 16 in synchronism with the movement of the surface of the photosensitive plate by conveyance means (not shown), a voltage of 1.5 to 4 kV is applied through the conductor of the transfer device to a conductive support 12 of the photosensitive plate by means of a DC power source 13. By so doing, a narrow electric field is imparted from the conductor 2 to the surface of the photoconductive palte 12*a* through the sheet of paper 14. At this time, the paper 14 is lightly attracted electrostatically to the surface of the transfer device 10 rather than to the photosensitive plate 12*a*, but this does not obstruct the paper conveyance.

A toner image 18 formed electrostatically on the surface of the photosensitive plate 12*a* is transferred to the surface of the paper 14 by virtue of the forgoing electric field. During the transfer, the surface of the paper may lightly contact the toner image, but the paper will never crush the toner image because it is attracted to the surface of the transfer device, and there will occur no such defects as omission, deformation and deteriorated resolution of the transfer toner image.

After transfer of the toner image 18 onto the surface of the paper 14, the paper separates from the surface of the photosensitive plate due to its own stiffness. This separation can be done extremely easily because the paper 14 is not electrically charged. When a voltage of DC 3 kV is applied to the conductor 2 of the transfer device 10, there flows an electric current not more than 0.2 μA between the transfer device 10 and the photosensitive plate 12 in the absence of the paper 14, while a little larger current flows therebetween in the presence of the paper 14. In this case, the transfer efficiency and resolution of the transferred toner image are not less than 80% and not less than 7 lP/mm, respectively. The toner image on the surface of the photosensitive plate 12*a* before the transfer could be reproduced exactly.

Figure 4:
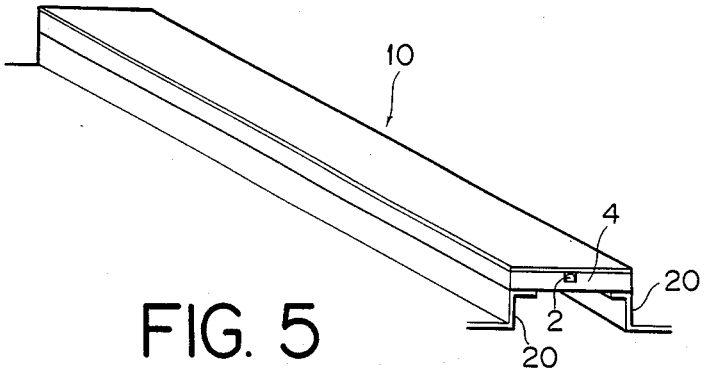
FIG. 4 is a perspective view showing how to support the transfer device.

The transfer device is supported as shown in FIG. 4. More specifically, the base plate 4 of the transfer device 10 is attached to conductive support members 20 by using a conductive adhesive so that the base plate is grounded. In this case, if the bonding area between the base plate 4 and the support members 20 is larger than necessary, a larger amount of electric current will leak from the conductor 2, so it is necessary to adjust the bonding area to prevent this inconvenience.

Figure 5:
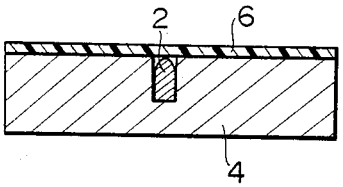
FIG. 5 is a sectional view in which a conductor having a knife edge-like upper end is used.

FIG. 5 is a transverse sectional view showing another shape of a conductor, whose upper or tip end is in the form of a knife edge having a radius of curvature not larger than 1.25 mm. Such a shape permits an easy mounting of the conductor to the base plate 4.

Figure 6:
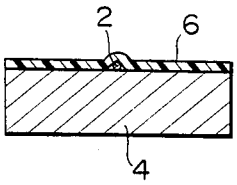
FIG. 6 is a sectional view of a transfer device according to another embodiment of the present invention in which a conductor is put directly on a base plate without forming a slot on the base plate.

In an effort to further facilitate the mounting of the conductor 2, a cylindrical conductor was put on the surface of the base plate 4 directly without forming a slot and then either covered with a coating layer having a surface resistivity not less than $10^{11}\Omega$ or held in place with an adhesive such as polyimide of Teflon, as shown in FIG. 6. As a result, it became clear that the transfer could be done without any trouble up to an applied voltage of 1.5–2.5 kV or so, but that at a higher voltage there would occur corona discharge at the convex coating portion formed by the presence of the conductor, thus causing disturbance of the transferred toner image.

It also became clear that in the case where the base plate was made of not a semiconductive material but an insulative material, corona discharge would occur at the coating surface portion covering a conductor, thus easily causing disturbance of the transferred toner image, not only in the case of putting the conductor on the base plate surface and covering it with an insulative coating but also in the case of forming a slot in the base plate surface and putting the conductor therein. Forming a slot in the surface of the semiconductive base palte 4, putting the conductor 2 therein and coating the surface thereof with an electrical insulating adhesive tape such as polyimide is a simple method, and this method was found to cause no obstacle to the transfer of toner as long as the adhesive force of the tape does not deteriorate.

Figure 7:
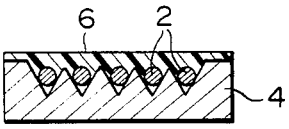
FIG. 7 is a sectional view of a transfer device according to a further embodiment of the present invention in which plural conductors are used.

Although in all of the above embodiments only one conductor is used for forming an electric field, two or more conductors each having a cylindrical or knife edge-like peripheral surface may be put on the base plate 4 as shown in FIG. 7 in the case where the paper is brought into contact over a certain width with the surface of the photoconductive plate or dielectric material which supports toner image. In the case of using two or more conductors as just mentioned, the transfer efficiency can be improved. And in the case, if the radius of curvature of the conductor is r, the distance d between adjacent conductors is preferably $r \leqq d \leqq 80r$. When three cylindrical conductors of $r=50\ \mu m$ were put on the base plate surface at intervals of $d=2$ mm as shown in FIG. 7, there was obtained a transfer rate of 85% at an applied voltage of 3 kV.

Although the width and thickness of the base plate were not specially limited in the foregoing description, it is necessary to adjust it according to the number of conductors used and in consideration of the thickness of conductor, the magnitude of leak current, etc.

The base plate of the transfer device may have a curved surface such as a cylindrical or arcuate surface, whereby the surface of the transfer device can function as a guide member for maintaining the position of the paper surface in the transfer portion at an exact spacing from the surface of a toner image bearing member such as a photosensitive plate or dielectric material.

In addition to the construction in which the toner image bearing member is rotated with respect to the transfer device, the transfer device may be so constructed as to move relative to the toner image beaing member which is kept stationary, and even in the latter case the function and effect attained are the same as in the former.

The elongated conductor used for inducing an electric field may have an elliptic peripheral surface in section. In short, its sectional shape may be changed so that a concentrative electric field of a desired width can be formed.

Further, the coating layer which covers the base plate surface so as to enclose the conductor need not be provided if dielectric breakdown of air does not occur at the conductor surface even in the absence of such coating layer when a transfer field inducing potential is applied to the conductor.

The transfer method and transfer device of the present invention can bring about the following meritorious effects.

(1) As compared with the conventional transfer method, the applied voltage is low and the current flow is small, so the power consumption can be reduced.

(2) Because it is not necessary to induce corona discharge, the shield of corotron charging device is no longer necessary, so it is possible to attain simplification of structure and reduction of size and cost.

(3) Since the transferring electric field is narrower than that in the conventional transfer method, the transferred toner image is less likely to be distrubed.

(4) Since there is no possibility of ion inflow to a photosensitive plate, the photosensitive palte is not deteriorated.

(5) Since an electric charge is not imparted to a sheet of paper, the paper after transfer is not attracted to the surface of a toner image bearing member such as a photosensitive plate or dielectric material; that is, it is not necessary to use a deelectrifying means, and the paper separation is easy.

(6) Since the paper is not electrically charged, its resistance does not lower even under a high ambient humidity, and so a transfer defect is hard to occur.

(7) Since the transfer device does not press the paper against the surface of a photosensitive palte or dielectric material, there will be no defect caused by pressing in the transferred toner image.

While the invention has been described and shown with particular reference to the preferred embodiment, it will be apparent that variations might be possible that would fall within the scope of the present invention which is not intended to be limited except as defined in the following claims.

What is claimed is:

1. An electric field transfer method of transferring toner image formed on a surface of an electrostatic latent image bearing member to a sheet of toner receiving member, the latent image bearing member having a conductive substrate laminated thereto, comprising:

(a) laying an elongated conductive member on a surface of a substrate having volume resistivity of about $10^6$ to $10^{16}\Omega$.cm and surface resistivity of about $10^6$ to $10^{16}\Omega$, said elongated conductive member having a cylindrical or knife edge-shaped top surface whose radius of curvature is less than about 3 mm;

(b) disposing the surface of said substrate in close proximity with the surface of said latent image bearing member having a toner image formed thereon;

(c) passing a sheet of toner receiving member between the surface of said latent image bearing member having the toner image formed thereon and the surface of said substrate having the elongated conductive member laid thereon; and (d) applying a high DC voltage between the elongated conductive member and the conductive substrate of said latent image bearing member thereby forming a narrow electric field between the surface of said latent image bearing member and the elongated conductive member whereby the toner image is transferred from the surface of said latent image bearing member to said sheet of toner receiving member.

2. An electric field transfer method according to claim 1 wherein applied high DC voltage is about 1.5 kV to about 4 kV.

3. An electric field transfer method according to claim 2 wherein polarity of DC voltage is same as that of an electrostatic latent image.

4. A transfer device for transferring toner image formed on a surface of an electrostatic latent image bearing member to a sheet of toner receiving member, comprising:

a substrate formed of a material having volume resistivity of about $10^6$ to $10^{16}\Omega$.cm and surface resistivity of about $10^6$ to $10^{16}\Omega$;

an elongated conductive member laid on the surface of said substrate, said elongated conductive member having a cylindrical or knife edge-shaped top surface whose radius of curvature is less than about 3 mm; and a coating layer for coating said substrate enclosing said elongated conducitve member therebetween, said coating layer having volume resistivity of more than about $10^{11}\Omega$.cm and surface resistivity of more than about $10^{11}\Omega$.

5. A transfer device according to claim 4 wherein said substrate has an elongated groove formed therein and wherein said elongated conductive member is laid in the groove.

6. A transfer device according to claim 5 wherein said groove is V-shaped.

7. A transfer device according to claim 4 wherein said elongated conductive member is laid directly on the surface of said substrate having no groove formed therein.

8. A transfer device according to claim 4 wherein a plurality of elongated conductive members are laid on the substrate.

* * * * *